United States Patent [19]

Hildebrandt et al.

[11] 3,935,779

[45] Feb. 3, 1976

[54] MITRE BOX

[75] Inventors: William J. Hildebrandt, West Simsbury; Richard H. Russell, Farmington, both of Conn.

[73] Assignee: The Stanley Works, New Britain, Conn.

[22] Filed: Nov. 27, 1974

[21] Appl. No.: 527,541

[52] U.S. Cl. ..... 83/762; 83/821

[51] Int. Cl.[2] ..... B27G 5/02

[58] Field of Search ..... 83/761, 762, 763, 764, 83/765, 766, 767, 743, 745, 821

[56] References Cited

UNITED STATES PATENTS

| | | | |
|---|---|---|---|
| 731,919 | 6/1903 | Larson | 83/762 |
| 3,171,453 | 3/1965 | Brownrigg | 83/762 |
| 3,397,722 | 8/1968 | Long | 83/762 |
| 3,782,235 | 1/1974 | Curcio | 83/762 |

*Primary Examiner*—Donald R. Schran

[57] ABSTRACT

An integrally molded synthetic resin mitre box has an elongated base portion, rigid post members spaced along one side thereof and a rigid guide member on the opposite side thereof. The guide member and posts have aligned vertical channels therein opening at the top surface thereof and providing guide channels for a saw blade at varous angular orientations relative to the longitudinal axis of the mitre box. The post members and guide member are of generally hollow construction with inverted columnar portions providing the channels. The base portion is provided with apertures, and a depending lip is provided along one side for secure placement against a worktable or the like.

12 Claims, 10 Drawing Figures

MITRE BOX

BACKGROUND OF THE INVENTION

Because of the significant advantages afforded by mitre boxes and the increasing do-it-yourself market, there has been a continuing desire to provide a relatively low cost and durable mitre box for use by the home craftsman. Conventional wood mitre boxes of generally U-shaped cross section provided with angular slots in the upstanding walls have been made and sold and have been fabricated by some home craftsmen. These wood mitre boxes are generally satisfactory for most applications but tend to be heavy and cumbersome when there is a necessity for transporting from one place to another or for mounting, dismounting and storage. Moreover, such mitre boxes do not afford good control over the workpiece which is received in the space between the upstanding sidewalls.

There have been a number of efforts to fabricate relatively simple mitre boxes from synthetic plastic as exemplified by U.S. Pat. No. 3,782,235 granted on Jan. 1, 1974 to Michael P. Curcio. Others have attempted to use synthetic resins to fabricate elements of mitre boxes as exemplified by U.S. Pat. No. 2,748,811 granted on June 5, 1956 to Joseph S. Chilton. Exemplary of efforts to make wooden mitre boxes of relatively simple construction are Larson U.S. Pat. No. 731,919 granted on June 23, 1903 and Long U.S. Pat. No. 3,397,722 granted Aug. 20, 1968. Use of a post construction to guide the saw blade has been suggested in Currier U.S. Pat. No. 446,431.

Until the present time, there has yet to be developed a simple and relatively lightweight and inexpensive mitre box with good dimensional stability and guide accuracy for the saw blade. Efforts to employ synthetic resins for the manufacture of such mitre boxes have failed to fully account for the advantages and disadvantages of such materials.

Accordingly, it is an object of the present invention to provide a novel mitre box integrally molded from synthetic resin and providing a relatively long-lived and lightweight structure.

It is also an object to provide such a mitre box which may be fabricated relatively inexpensively and which affords good control over the workpiece disposed therein.

A further object is to provide such a mitre box which is relatively rugged, dimensionally stable and resistant to normal abrasion occurring during use.

SUMMARY OF THE INVENTION

It has now been found that the foregoing and related objects may be readily attained in a mitre box comprising an integrally molded structure of synthetic resin having an elongated base portion, a plurality of rigid post members spaced apart along one side thereof, and a rigid elongated vertically extending guide member on the opposite side thereof aligned with one of the post members. The guide member and the one post member have aligned vertical channels therein extending perpendicularly to the longitudinal axis of the mitre box and the guide member has at least one additional vertical channel therein spaced along the length thereof from the first mentioned channel therein and this additional channel extends at an angle to the longitudinal axis of the structure. Another of the guide posts has a vertical channel therein which is aligned with the angular channel of the guide member, and all of the channels open at the top surface of the posts and guide member.

In accordance with the preferred embodiment of the invention, the post members and guide member each have a peripheral wall extending upwardly from the base portion and defining a downwardly opening cavity. The post members and guide member have sidewall portions extending transversely of the length of the channels therein and a bottom wall portion extending between the sidewall portions to provide a closed channel which extends to adjacent the top surface of the base portion. The post members and guide member each include inverted columnar portions extending downwardly from the top wall and within the periphery thereof to provide the channels with their sidewalls and bottom walls.

Preferably, at least one post member is spaced to either side of the post member containing the perpendicularly extending channel, and these have channels therein of different angular orientation which cooperate with aligned channels in the guide member. Accordingly, the guide member has a multiplicity of channels spaced along the length thereof cooperating with the channels of the post members and providing to a saw received therein different angular orientations relative to the longitudinal axis of the structure. To provide strength and rigidity of assembly, the structure includes upstanding guide flanges spaced from the guide member along that side thereof.

For seating threaded fasteners or the like to secure the mitre box to a support surface, the base portion includes a plurality of apertures. To permit sawdust and the like to fall therethrough, the base portion also has relatively large spaced apertures extending therethrough. A depending lip portion extending below the plane of the base portion and along one side thereof provides an inside guide surface which may be pressed against the edge of a worktable or the like to provide firm support therefor.

DETAILED DESCRIPTION OF THE ILLUSTRATED EMBODIMENTS

Figure 1:
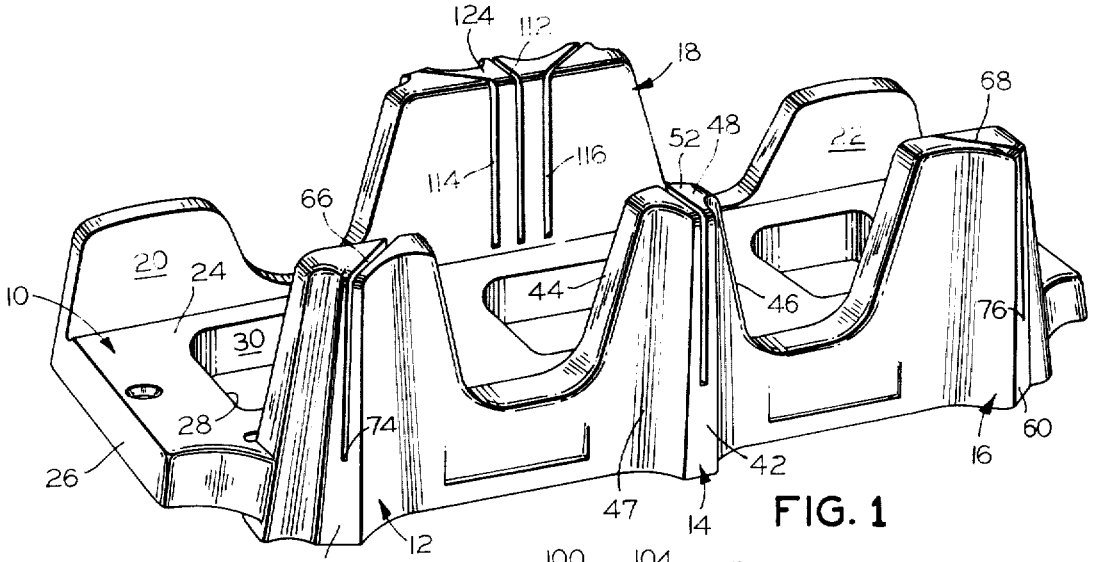
FIG. 1 is a perspective view of a mitre box embodying the present invention.

Turning now to the attached drawings in detail, the mitre box is integrally molded with a base portion generally designated by the numeral 10, spaced guide posts generally designated by the numerals 12, 14 and 16 along one side thereof and an upstanding guide member generally designated by the numeral 18 adjacent the midpoint of the of the other side thereof. Also provided on the same side as the guide member 18 and spaced therefrom are upstanding guide flanges 20 and 22.

Figure 2:
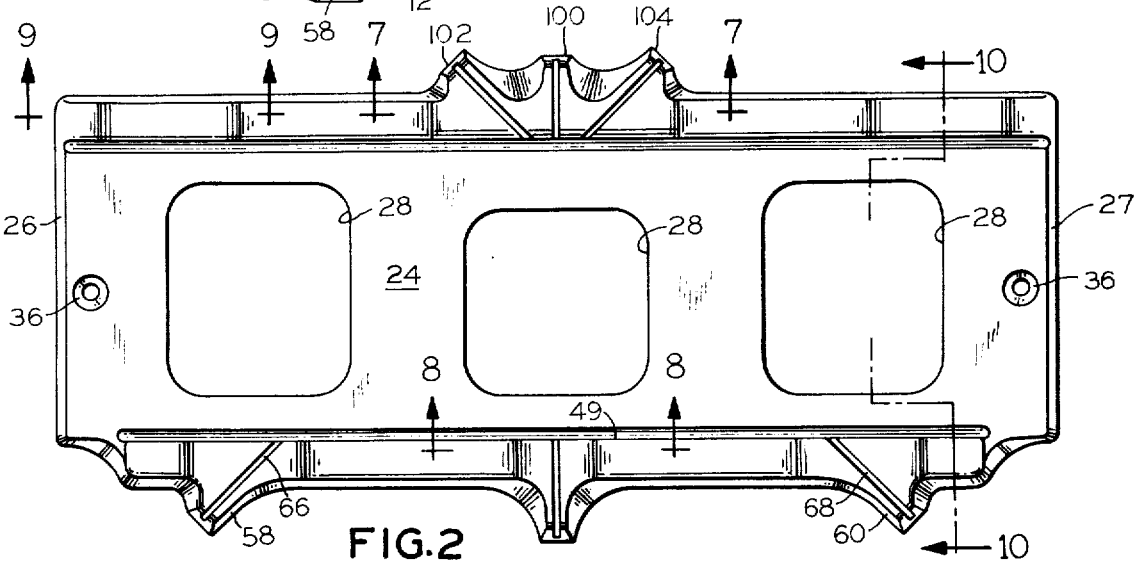
FIG. 2 is a plan view thereof.
Figure 3:
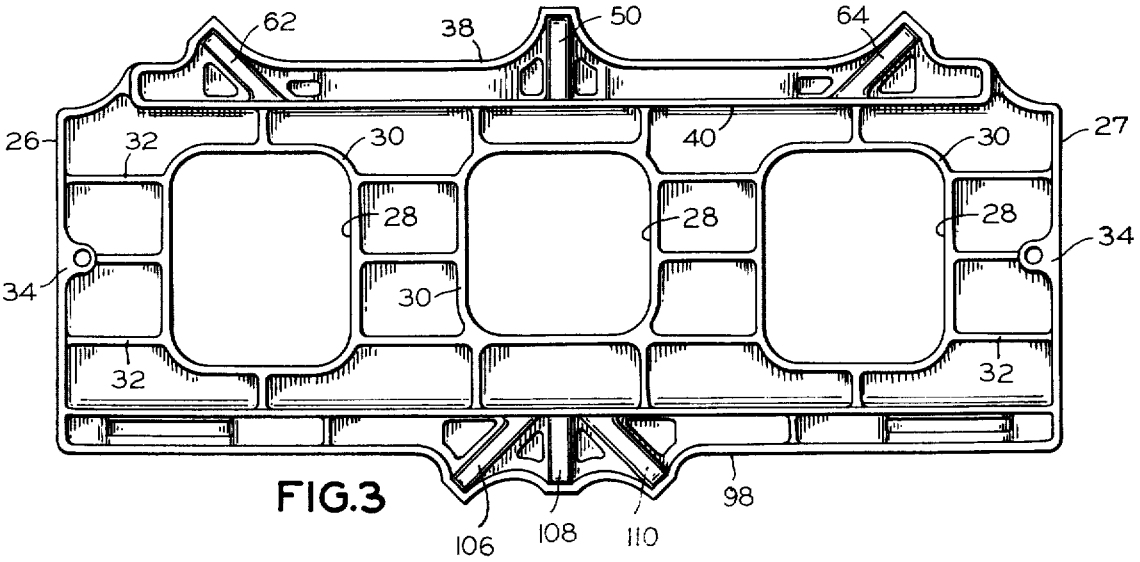
FIG. 3 is a bottom view thereof.
Figure 4:
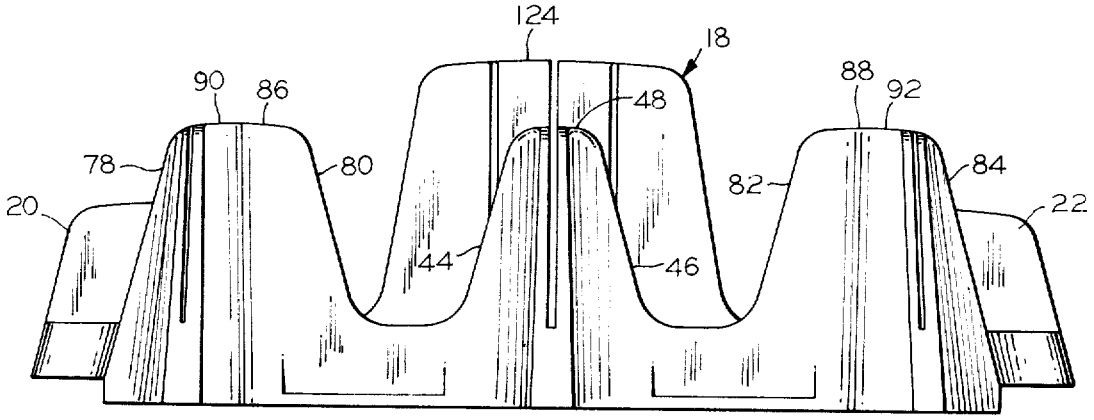
FIG. 4 is an elevational view of the side having the vertical guide posts.
Figure 5:
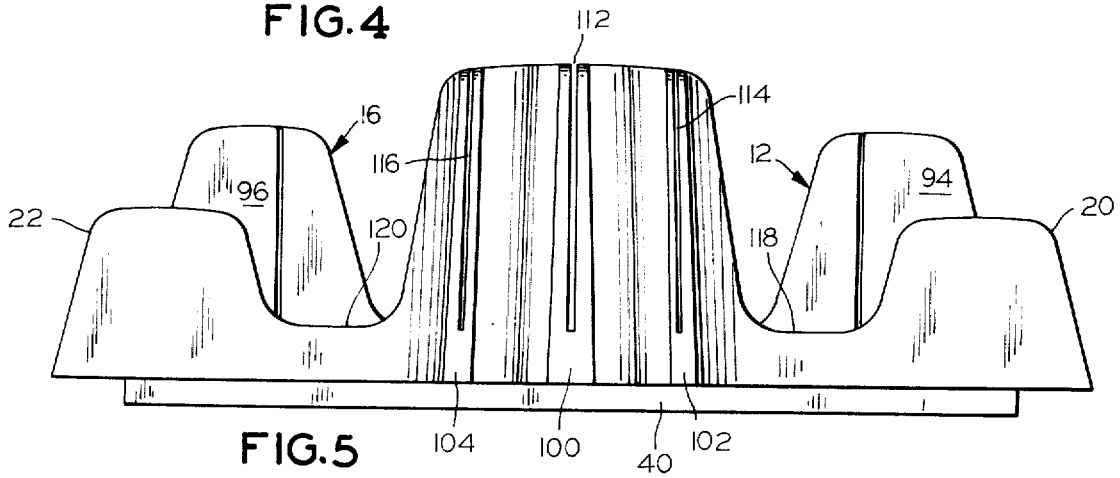
FIG. 5 is an elevational view of the opposite side.
Figure 6:
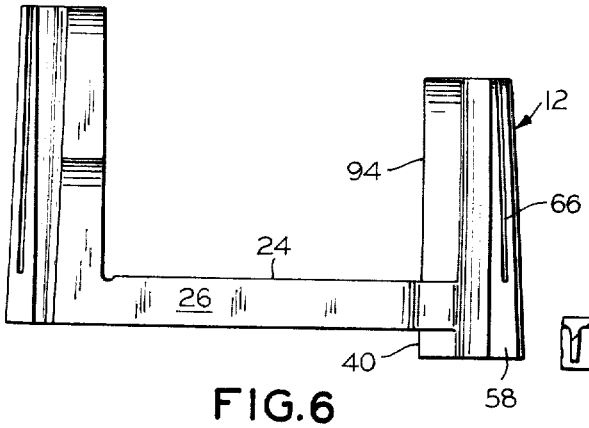
FIG. 6 is an end elevational view.
Figure 10:
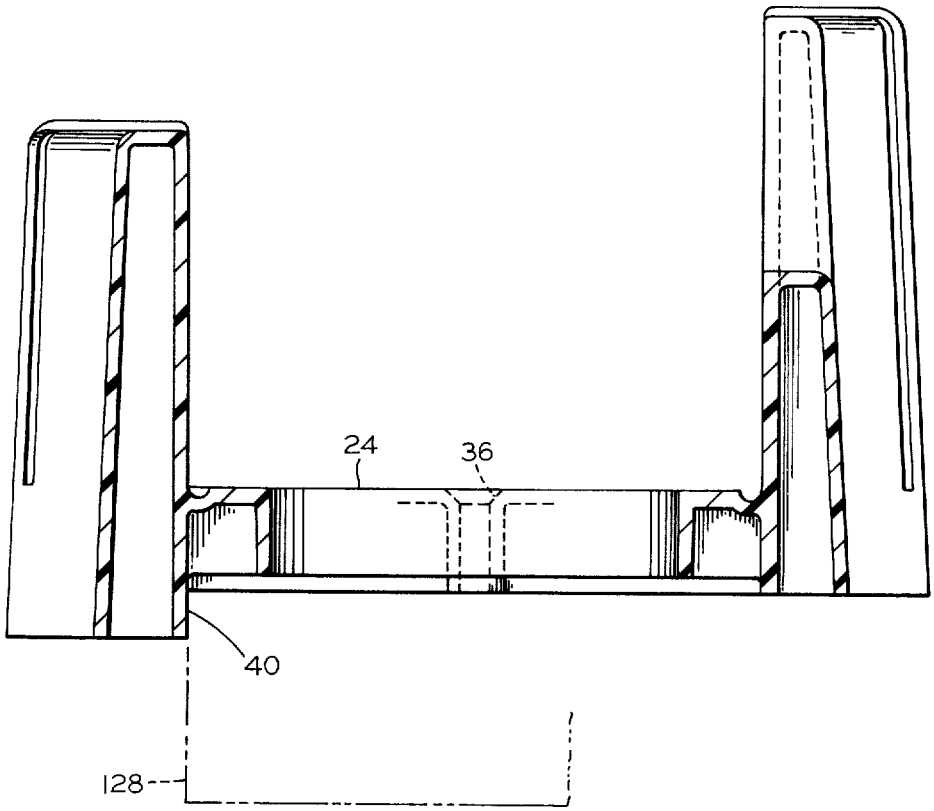
FIG. 10 is a fragmentary sectional view along the line 10—10 of FIG. 4 with a worktable surface being illustrated in phantom line.

As best seen in FIGS. 2, 3 and 10, the base portion has a generally planar upper surface 24, depending end skirts 26, 27 and apertures 28 spaced across the length thereof and defined by depending wall portions 30. Ribs 32 extend between the wall portions 30, skirt 26 and the longitudinal side portions to provide stable seating of the base portion 10 upon a support surface such as a worktable and reinforce the structure so as to provide substantial rigidity. Adjacent the two ends are solid portions 34 which project inwardly from the skirts 26, 27 and which have countersunk apertures 36 therein to seat threaded fasteners or the like for mounting of the mitre box upon a worktable or like surface.

The forward side of the mitre box which is provided with the posts 12, 14 and 16 has a depending lip portion 38 of inverted U-shaped cross section which extends below the lower surface of the base portion 10 and which provides a longitudinally extending vertical guide surface 40 adapted to be pressed firmly against the edge of a worktable or the like support surface to provide stable seating of the mitre box.

Figure 8:
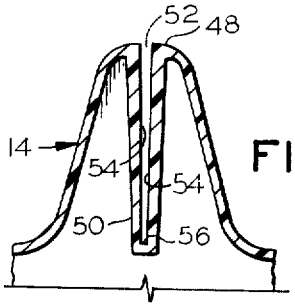
FIG. 8 is a fragmentary sectional view along the line 8—8 of FIG. 2.
Figure 9:
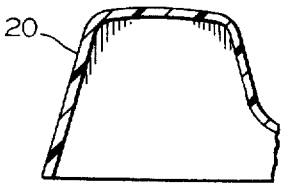
FIG. 9 is a fragmentary sectional view along the line 9—9 of FIG. 2.

The central guide post 14 projects upwardly from the plane of the upper surface of the base portion 10 and has a perpendicularly projecting wing portion 42 at the midpoint thereof. The end surfaces 44 and 46 taper upwardly towards each other and the outer side surface 47 also tapers upwardly and inwardly to provide a reduced cross section at the top wall 48. However, the side surface 49 is substantially perpendicular. As is best seen in FIGS. 3, 8 and 10, an inverted columnar portion 50 extends downwardly from the top wall 48 and provides a channel 52 opening at the top wall 48 and extending downwardly to adjacent the upper surface of the base portion 10. This columnar portion 50 is disposed within the periphery of the guide member 14 and provides solid sidewalls 54 and a bottom wall 56 for the channel 52.

The posts 12 and 16 are of generally similar construction and are spaced to either side of the central guide post 14. They have diverging wing portions 58 and 60 extending outwardly from the base portion 10 and include angularly ariented inverted columnar portions 62, 64 which define the channels 66 and 68, and provide sidewalls 70 and 72, and bottom walls 74 and 76 therefor. As in the instance of the central guide post 14, they are provided with end surfaces 78, 80 and 82, 84 and outer side surfaces 86, 88 which taper inwardly towards the top walls 90 and 92 thereof while the inner side surfaces 94, 96 are perpendicular.

Figure 7:
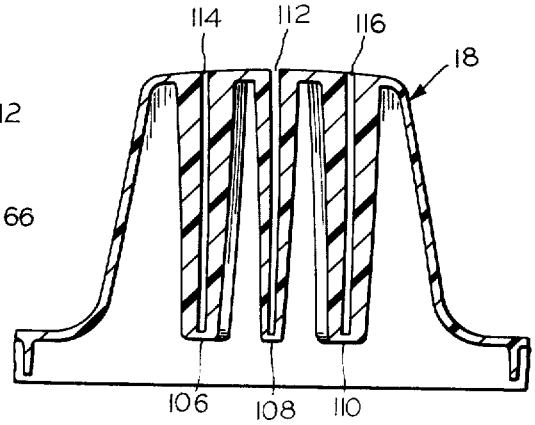
FIG. 7 is a fragmentary sectional view along the line 7—7 of FIG. 2.

The opposing side surface is provided with the guide member 18 and upstanding flanges 20 and 22 spaced along the length thereof rising from a box portion 98 of inverted U-shaped cross section. As best seen in FIGS. 2, 3 and 7, the guide member 18 has a wing portion 100 extending laterally outwardly therefrom perpendicularly to the longitudinal axis of the mitre box and at about the midpoint thereof, and wing portions 102, 104 spaced to either side thereof and angularly disposed relative to the longitudinal axis. The guide member 18 includes three inverted columnar portions 106, 108, 110 aligned with the wing portions 100, 102, 104, and which provide the perpendicularly extending central channel 112 and the converging channels 114, 116 to either side thereof which are aligned with the channels 68, 66 respectively in the guide posts 16 and 12. As can be seen the perpendicular central channel 112 is aligned with the channel 52 in the guide post 14.

The guide flanges 20, 22, which are spaced from the guide member 18, are connected therewith by web portions 118, 120 and are of lesser height than the guide member 18. The inner side surfaces of each of the guide member 18 and flanges 20, 22 are substantially vertical while the outer side surfaces and the end surfaces do taper upwardly to provide a reduced cross section at the top walls 122, 124, 126 thereof. The channels 112, 114, 116 open at the top wall 124 of the guide member 18 and extend to the plane of the top surface of the base portion 10.

In operation of the mitre box, it is most conveniently secured to the top surface of a worktable or the like by pressing the inside surface 40 of the lip 38 against the edge of the worktable. Screws or similar fasteners are then seated in the apertures 36 to mount the box securely although for limited applications the user may rely solely upon the pressure applied between the lip 38 and worktable to prevent relative movement. To minimize the likelihood of scarring the planar surface of the base portion 10, it is desirable to place a thin piece of plywood or the like within the mitre box upon this surface and to replace it as necessary. The workpiece to be cut is then introduced into the mitre box and oriented relative to the appropriate channels selected for producing the desired angular cut. The workpiece can be firmly held against the perpendicular inner walls of either the guide posts 12, 14, 16 or the guide member 18 and flanges 20, 22 to maintain stability during the cutting operation. The openings provided by the spacing between the guide posts 12, 14, 16 or between the guide member 18 and flanges 20, 22 readily accommodate the user's hand to permit him to grip the workpiece and apply both downward and sideward pressure to prevent relative movement.

The channels in the posts and guide member are of a width sufficient to accommodate the width of the average saw blade toothed portion, but are sufficiently narrowly dimensioned to ensure properly guiding action of the saw blade in a vertical path. It can be seen that relatively large bearing surfaces are provided by the wing portions which contain the channels. Sawdust resulting from the cutting operation tends to be expelled from the channels and also falls into the relatively large apertures 28 in the base portion 10.

Various synthetic resins may be employed for the fabrication of the mitre box including polypropylene, high density polyethylene, acrylonitrile/butadiene/styrene interpolomers, polycarbonate, polyacetals, polyamides and resin systems including glass or other fillers and reinforcing agents. The preferred resins are those which exhibit a reasonably high degree of impact resistance and are also resistant to abrasion.

It will be readily apparent that additional channels may be provided along both sides to enable still more or different angular orientations of the saw blade relative to the longitudinal axis of the mitre box. It is possible also to fabricate the mitre box with transversely extending channels in the upper surface of the base portion aligned with the channels in the guide member and guide posts so as to minimize the likelihood of cutting of the top surface of the base portion. Other variations in construction and appearance will be apparent to those having skill in the art.

From the foregoing detailed description and the attached drawings, it can be seen that the present invention provides a relatively economical, lightweight and durable mitre box which can be fabricated as a integral structure form synthetic resin. The mitre box has highly satisfactory bearing surfaces for guiding the saw in its cutting action and enables firm gripping of the workpiece within the mitre box to avoid inadvertent relative movement.

Having thus described the invention, we claim:

1. A mitre box comprising an integrally molded structure of synthetic resin having an elongated base portion, a plurality of rigid post members spaced apart along one side thereof, and a rigid elongated vertically extending guide member on the opposite side thereof aligned with one of said post members, said guide member and said one post member having aligned vertical channels therein extending perpendicularly to the longitudinal axis of said structure, said guide member having at least one additional vertical channel therein spaced along the length thereof from said first mentioned channel therein and extending at an angle to the longitudinal axis of said structure, another of said guide posts having a vertical channel therein aligned with the angular channel of said guide member, said channels opening at the top surface of said posts and guide member, said post members and guide member each having a peripheral wall extending upwardly from said base portion and a cavity therewithin.

2. The mitre box in accordance with claim 1 wherein said cavity of each of said post members and guide member is downwardly opening.

3. The mitre box in accordance with claim 2 wherein said post members and guide member have sidewall portions extending transversely of the length of the channels therein and a bottom wall portion extending between said sidewall portions to provide a closed channel.

4. The mitre box in accordance with claim 3 wherein said post members and guide member each include inverted columnar portions extending downwardly from the top wall thereof and within the periphery thereof to provide said channels with their side walls and bottom walls.

5. The mitre box in accordance with claim 1 wherein said channels extend to adjacent the top surface of said base portion.

6. The mitre box in accordance with claim 1 wherein there is provided at least one post member spaced to either side of said post member containing the perpendicularly extending channel, said spaced post members having channels therein of different angular orientation than that of the other and cooperating with aligned channels in said guide member, said guide member having a multiplicity of channels spaced along the length thereof cooperating with said channels of said spaced post members and providing to a saw received therein different angular orientations relative to the longitudinal axis of said structure.

7. The mitre box in accordance with claim 1 wherein said structure includes upstanding guide flanges spaced along said opposite side thereof and spaced from said guide member.

8. The mitre box in accordance with claim 1 wherein said base portion includes a plurality of apertures for seating threaded fasteners or the like to secure said mitre box to a support surface.

9. The mitre box in accordance with claim 1 wherein said base portion has relatively large spaced apertures extending therethrough to permit sawdust and the like to fall therethrough.

10. The mitre box in accordance with claim 1 wherein said structure includes a depending lip portion extending below the plane of said base portion and along one side thereof whereby the inside surface of said lip portion may be pressed against the edge of a worktable or the like to provide firm support therefor.

11. The mitre box in accordance with claim 1 wherein there is provided at least one post member spaced to either side of said post member containing the perpendicularly extending channel, said spaced post members having channels therein of different angular orientation than that of the other and cooperating with aligned channels in said guide member, said guide member having a multiplicity of channels spaced along the length thereof cooperating with said channels of said spaced post members and providing to a saw received therein different angular orientations relative to the longitudinal axis of said structure and wherein there is included upstanding guide flanges spaced along said opposite side thereof and spaced from said guide member, the opposing wall faces of said posts, guide member and flanges being substantially vertical to permit stable seating of a workpiece thereagainst.

12. The mitre box in accordance with claim 1 wherein said base portion includes a plurality of apertures for seating threaded fasteners or the like to secure said mitre box to a support surface and wherein said structure includes a depending lip portion extending below the plane of said base portion and along one side thereof whereby the inside surface of said lip portion may be pressed against the edge of a worktable or the like to provide firm support therefor.

* * * * *